US005856642A

United States Patent [19]

Sanders

[11] Patent Number: 5,856,642

[45] Date of Patent: Jan. 5, 1999

[54] CLUTCH COUPLED SWITCH OPERATOR

[75] Inventor: Dean Carnell Sanders, Linden, Calif.

[73] Assignee: Inertia Engineering and Machine Works, Inc., Stockton, Calif.

[21] Appl. No.: 768,403

[22] Filed: Dec. 18, 1996

Related U.S. Application Data

[60] Provisional application No. 60/026,463 Sep. 20, 1996.

[51] Int. Cl.[6] ..... H01H 3/00

[52] U.S. Cl. ..... 200/17 R; 200/18; 200/50.21; 200/50.32; 218/84

[58] Field of Search ..... 200/17 R, 18, 200/501, 50.21, 50.32, 50.39; 218/2, 5, 7, 14, 78, 84, 92, 119, 120, 140, 152, 153, 154

[56] References Cited

U.S. PATENT DOCUMENTS

| | | | |
|---|---|---|---|
| 2,068,402 | 1/1937 | Duffing et al. . | |
| 2,959,649 | 11/1960 | Powell . | |
| 3,026,388 | 3/1962 | Johnson . | |
| 3,213,235 | 10/1965 | Soos . | |
| 3,286,211 | 11/1966 | Soos . | |
| 3,359,464 | 12/1967 | Henderson . | |
| 3,432,780 | 3/1969 | Evans et al. . | |
| 3,508,179 | 4/1970 | Bernatt et al. . | |
| 3,980,977 | 9/1976 | Evans . | |
| 4,101,746 | 7/1978 | Grieger et al. | 218/84 |
| 4,107,486 | 8/1978 | Evans . | |
| 4,195,211 | 3/1980 | Aslan et al. | 200/50.32 |
| 4,351,994 | 9/1982 | Evans et al. . | |
| 4,396,813 | 8/1983 | Hesselbart et al. | 200/50.21 |

*Primary Examiner*—Khanh Dang
*Attorney, Agent, or Firm*—Virginia H. Meyer, Esq.

[57] ABSTRACT

The present invention provides a clutch-coupled crossarm mounted switch operator. The switch operator of the invention includes rotational motor means, a non-positive contact or infinite engagement clutch mechanism, and an output coupling. The rotational motor means further includes an input shaft to which the clutch mechanism is coupled. The infinite engagement clutch mechanism does not depend on rotational alignment means for engagement of the clutch. The clutch further includes an output shaft to which the output coupling is coupled. The output coupling is in turn coupled to a gang operated switch element that causes the switch contacts of the gang operated switch to open and close. Use of the clutch coupled switch operator thus effects the opening and closing of the gang operated switch contacts. Further, disengagement of the clutch mechanism allows the user to exercise and test the rotational motor means without displacing the contacts of the gang operated overhead high voltage air switch. Furthermore, the present invention includes means to manually operate gang-operated switches.

22 Claims, 2 Drawing Sheets

CLUTCH COUPLED SWITCH OPERATOR

RELATED APPLICATION

This application claims the benefit of U.S. Provisional Application No. 60/026,463, filed Sep. 20, 1996 by Express Mail (label no. EH501609128US), having Attorney Docket No. 6362/53013.

BACKGROUND OF THE INVENTION

1. Field of the Invention

The present invention relates to high-voltage, overhead, non-enclosed electric switches. More particularly, the present invention relates to a switch operator for opening and closing gang operated, high-voltage electrical switches.

2. Description of the Prior Art

Many devices for operating overhead, high-voltage air switches are known in the art. For example, Pat. No. 3,508,179 issued to Bernatt et al. on Apr. 21, 1970, Pat. No. 3,026,388 issued to Johnson on Mar. 20, 1962, Pat. No. 4,107,486 issued to Evans on Aug. 15, 1978, and Pat. No. 3,432,780 issued to Evans et al on Mar. 11, 1969 illustrate various prior art devices. Generally, these devices incorporate a ground-level mounted switch operator and a control rod or shaft that extends from the operator, along the switch pole, and then to the overhead switch. The switch operator must exert a significant force through the control rod to effect opening and closure of the switch contacts. These prior art devices are suitable for operating on three phase group operated or gang-operated switches. These types of devices, however, create the risk that workmen can become entangled in the operator mechanisms and can be injured in the event of a remote operation of the switch operator. Furthermore, the need to pre-load and post-load the control rod or shaft in order to realign a positive engagement clutching mechanism presents difficulties and hazards to workmen when coupling or decoupling the operator to conduct manual operation or motor maintenance.

Crossarm mounted operators eliminate these safety hazards and reduce the installation cost of a switch operating device. One prior art crossarm mounted switch operator is disclosed in U.S. Pat. No. 3,980,977, which issued to Evans on Sept. 14, 1976. Evans discloses the use of a coiled spring switch operator designed for use in enclosed high-voltage switches. This device incorporates a spring that is coiled or loaded by a DC motor. The loaded spring is released to apply a pre-determined force to an output shaft causing the switch contacts to change state. The coil spring operator is integral to the switch and, therefore, cannot be removed from the switch for repair or adapted to another type of switch. Furthermore, a fully coiled spring stores enough energy for several operations, but requires about ninety seconds to be recoiled. Under emergency situations, this time lag can pose a significant functional problem.

Another prior art crossarm mounted switch operator incorporates a linear ball screw coupled to a DC motor with a normally active motor brake that releases when the motor is energized. This device connects to a shaft and linkage extending from one of the rotating insulators on a switch phase of a gang operated switch. This configuration makes no provision, however, to allow the switch operator to be disengaged from the switch so that the switch can be manually operated in the event of a switch operator failure. This configuration also prevents the unit from being periodically tested and maintained without removal of the switch operator from the switch, because the switch contacts cannot remain stationary when the operator motor is exercised.

Yet another prior art device includes a "gear dog" operator as built by Kearney-KPF, Inc. This gear dog operator uses an engagement mechanism incorporating a mating set of tooth beveled gears, or "gear dogs," to couple the motor input to the output shaft of the switch operator. A compression spring supplies the force required to keep the gears engaged. A DC motor is the power source. The output shaft is connected to the phase connecting rod which, when operated, forces the rotating insulators to open the switch. This unit allows the overhead gang-operated switch to be operated manually, but does not allow the DC motor to be exercised for testing and maintenance without displacing the switch contacts. Additionally, the spring that maintains the gear dog engagement is subject to relaxation over time and could allow the gears to disengage during or after switch operation. Furthermore, realignment of the gears can be difficult after the switch has been manually operated. Notably, after manual operation the gears will often not remesh. The user must physically manipulate the switch contacts to realign the gears in order to recouple or remesh the gear dog engagement mechanism. Such conditions pose undue risks to workmen.

While the devices of the prior art fulfill their respective objectives and requirements, the prior art switch operators do not describe or suggest a crossarm mounted switch operator that incorporates an infinite engagement clutch coupling mechanism that allows for manual operation of the switch and for testing and maintenance of the switch operator without the disadvantages associated with prior art devices. Namely, the switch operator of the present invention allows the user to effectively engage and/or disengage the switch operator without the alignment, pre-loading, and post-loading problems associated with the prior art devices described above. In this respect, the switch operator according to the present invention represents a substantial improvement over the concepts and switch operator designs of the prior art, and in doing so provides a novel switch operator having an infinite engagement clutch coupling mechanism primarily developed for operating overhead, gang-operated switches and allowing manual operation and testing thereof without movement of the switch contacts. Therefore, it can be appreciated that a need exists for a new switch operator that employs an infinite engagement clutch coupling mechanism which eliminates the alignment, pre-loading and post-loading problems of the prior art. In this regard, the present invention substantially fulfills these needs.

SUMMARY OF THE INVENTION

The present invention provides a novel apparatus for operating high-voltage outdoor electric switches, such as those of the moveable insulator type wherein a stationary insulator carrying switch jaws and a moveable insulator carrying a switch blade are mounted on a common support. The invention provides novel means for moving the switch or switches to either the open or closed position and preventing them from changing state from the position to which they have been moved. The present invention employs power operating mechanisms that are activated locally or remotely using electronic control devices. Additionally, the device of the present invention mounts directly to the switch phase structure of an overhead electrical switch, thus requiring no linkage and shafting assemblies on the switch pole.

The device of the present invention is particularly designed for operating groups or gangs of such high voltage outdoor or air switches. The present invention can be used, however, with high voltage outdoor switches of the vertical break rotating type, the single side break type, double side break type, and the line tension rotating insulator type. For the purposes of illustration, the present invention will be shown as used with a single pole supported, high-voltage, outdoor, side break rotating insulator three phase gang-operated switch.

More particularly, the present invention provides a new clutch coupled crossarm mounted switch operator. In its broadest context, the switch operator of the present invention comprises rotational motor means, a non-positive or infinite engagement clutch coupling mechanism, and an output coupling. The rotational motor means include an input shaft to which the clutch mechanism is coupled. The clutch mechanism of the present invention does not depend on alignment means for engagement of the clutch and further includes means to engage and disengage the clutch. According to the teaching of the invention, the clutch further includes an output shaft to which the output coupling is attached. The output coupling is in turn coupled to an element of a gang-operated high voltage air switch that connects the singular switches of the gang operated switch together and causes the switch phase contacts to open and close simultaneously. Operation of the clutch coupled switch operator thus effects opening or closing of the contacts of a gang or group operated high voltage air switch. The switch operator of the present invention, in preferred forms, may further include means to manually operate gang-operated switches.

According to the teaching of the invention, the rotational motor means can be any suitable means capable of supplying the required torque at an appropriate speed to operate the switch on which the operator is installed. The rotational motor means must also be bi-directional because the drive source rotates both clockwise and counter-clockwise. By way of example, the rotational motor means may comprise either an AC or a DC electrical motor that couples directly to the clutch mechanism. In other embodiments, the rotational motor means may comprise an AC or DC motor coupled to a torque and speed transforming device, such as a gear reduction unit. The function of the gear reduction unit is to modify the output of the motor such that the appropriate amount of torque is applied at the appropriate speed to the input shaft of the clutch coupling. This transforming device then couples to the clutch mechanism of the switch operator. In a preferred embodiment, the rotational motor means comprises a DC motor coupled to a gear reduction unit.

The use of an infinite engagement clutch coupling mechanism in the present invention eliminates the alignment problems of the prior art devices. Namely, the user need not displace or move any switch components to engage the clutch and resume automatic operation of the switch. The non-positive contact feature of the clutch coupling mechanism also eliminates the pre-loading and post-loading problems associated with the prior art. Accordingly, the clutch coupling of the present invention must necessarily not depend upon alignment of its halves for engagement or disengagement. As used herein, such a clutch is referred to as an "infinite engagement" or non-positive contact clutch. In other words, the position of the two clutch halves with respect to each other does not influence or prevent coupling or decoupling of the clutch. For example, after the user has decoupled the clutch to service the operator or manually operate the switch, the user need not manipulate the phase switch contacts in order to recouple the clutch. The clutch mechanism of the present invention may be any suitable clutch mechanism, as long as the clutch mechanism does not depend on alignment means for engagement of the clutch. Suitable clutch mechanisms include, but are not limited to, friction clutches, multiple disk clutches, magnetic clutches, cone clutches, internally expanding shoe-type clutches, bi-directional grip roller clutches, centrifugal clutches, cam clutches, and two way slip clutches.

Additionally, the present invention includes an output coupling attached to the output shaft of the clutch coupling mechanism. The output coupling of the present invention is the means by which the displacing force provided by the rotational motor means is translated to the gang operated air switch. The configuration of the output lever may be varied to meet the various requirements of different types and configurations of electrical switches. Accordingly, the exact configuration of the output coupling will depend on the design of the switch, and can be chosen by those skilled in the art, without undue experimentation. In a preferred embodiment, the output coupling is a lever that attaches to an element of the phase switch structure such that rotation of the clutch coupling output shaft displaces the output coupling and changes the state of the switch contacts.

In preferred embodiments, the switch operator of the present invention may further include a protective housing that covers the components of the switch operator. Such a housing may also include means by which the entire assembly is mounted to an element of a gang-operated switch. By way of example and in preferred forms, the housing includes brackets by which the switch operator is mounted to the crossarm of an overhead, gang-operated switch. The mounting means employed will depend upon the type of switch onto which the user desires to install the switch operator.

In use, the switch operator of the present invention must be connected to and controlled by suitable electronic/mechanical control equipment. Such control equipment includes a controller and limit or sensing switches that communicate to the controller the position of the switch contacts or the position of a component of the switch operator itself. A suitable controller must perform at least three functions: (1) it must supply power to the motor such that the motor effects displacement of the output shaft in a first direction; (2) it must be capable of turning this power off to stop the motor when an associated limit switch is engaged, and (3) it must be capable of reversing the power to the motor such that the motor effects displacement of the output shaft in a second direction opposite the first direction. In other embodiments and in preferred forms, the electronic control gear may further included means to indicate the state of engagement or disengagement of the clutch mechanism of the switch operator. It should be noted that assembly of an electronic controller that performs these functions is well known in the field and capable of many variations.

There has thus been outlined, rather broadly the more important features of the invention in order that the detailed description thereof that follows may be better understood, and in order that the present contribution to the art may be better appreciated. There are additional features of the invention that will be described hereinafter and which form the subject matter of the claims appended hereto.

In this respect, before explaining a preferred embodiment of the invention, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

As such, those skilled in the art will appreciate that the conception upon which this disclosure is based, may be utilized as a bases for the designing of other structures, methods and systems for carrying out the several purposes of the present invention. It is important, therefore, that the claims be regarded as including such equivalent constructions insofar as they do not depart from the spirit and scope of the present invention.

OBJECTS OF THE PRESENT INVENTION

Accordingly, it is a primary object of the present invention to provide a power operating device for gang-operated outdoor switchgear that allows for eliminating hazardous control shafting from the pole structure.

It is another object of the present invention to provide a switch operator that is not dependent upon the alignment of any driving or driven parts for coupling the motor unit to the output shaft.

It is yet another object of the present invention to provide a switch operator that allows testing and maintenance of the unit without affecting the position of the switch contacts.

It is yet another object of the present invention to provide a switch operator with the capability of being disengaged in order to allow manual operation of the switch in the event of a failure of the switch operator.

It is yet another object of the present invention to provide a switch operator that can be removed or installed without removing the switch from the supporting structure.

It is yet another object of the present invention to provide a switch operator that incorporates means to prevent the switch contacts from changing state when the operator is engaged or disengaged.

Another object of the present invention is to provide a means for reducing the shock encountered by the switch as it reaches an open or closed position.

It is yet another object of the present invention to provide a switch operator with the capability to be adaptable to a variety of manufacturers' switch configurations.

It is yet another object of the present invention to provide a switch operator that is economical and utilizes components that are commonly available and improved upon by those skilled in the trade.

It is yet another object of the present invention to provide a switch operator that has a lost motion means that allows for simple adjustment to the switch, reduces installation time and reduces maintenance caused by wear on the switch components.

These together with other objects of the present invention, along with various features of novelty that characterize the invention, are pointed to with particularity in the claims annexed to and forming part of this disclosure. For a better understanding of the present invention, its operating advantages and the specific objects attained by its uses, reference should be had to the accompanying drawings and descriptive matter which illustrates preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1A is a three-dimensional view of an outdoor, non-enclosed, gang-operated electric switch with a switch operator of the present invention installed thereon; and, FIG. 1B is a plan view of a gang operated switch with the switch operator of the present invention installed thereon.

The same reference numbers refer to the same parts throughout the various Figures.

DESCRIPTION OF A PREFERRED EMBODIMENT

With reference now to the drawings, a first preferred embodiment of the clutch coupled switch operator embodying the principles and concepts of the present invention and designated by the reference number 10 will be described.

Specifically, it will be noted in the various Figures that the invention relates to a clutch-coupled switch operator for opening and closing the switch contacts of an outdoor, overhead, gang-operated switch. In its broadest context, the invention comprises rotational motor means, a clutch coupling mechanism, and an output coupling or lever. In this embodiment, the switch operator further includes means to manually operate the switch. Such components are individually configured and correlated with respect to each other so as to attain the desired objective.

Figure 1A:
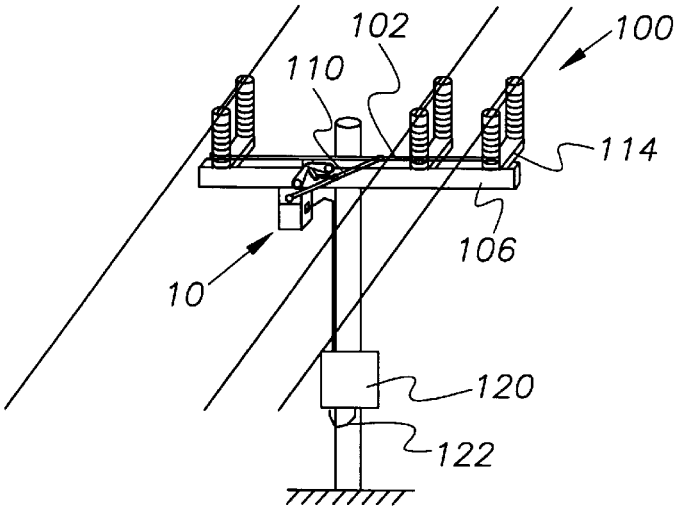
FIGS. 1A and 1B.
Figure 1B:
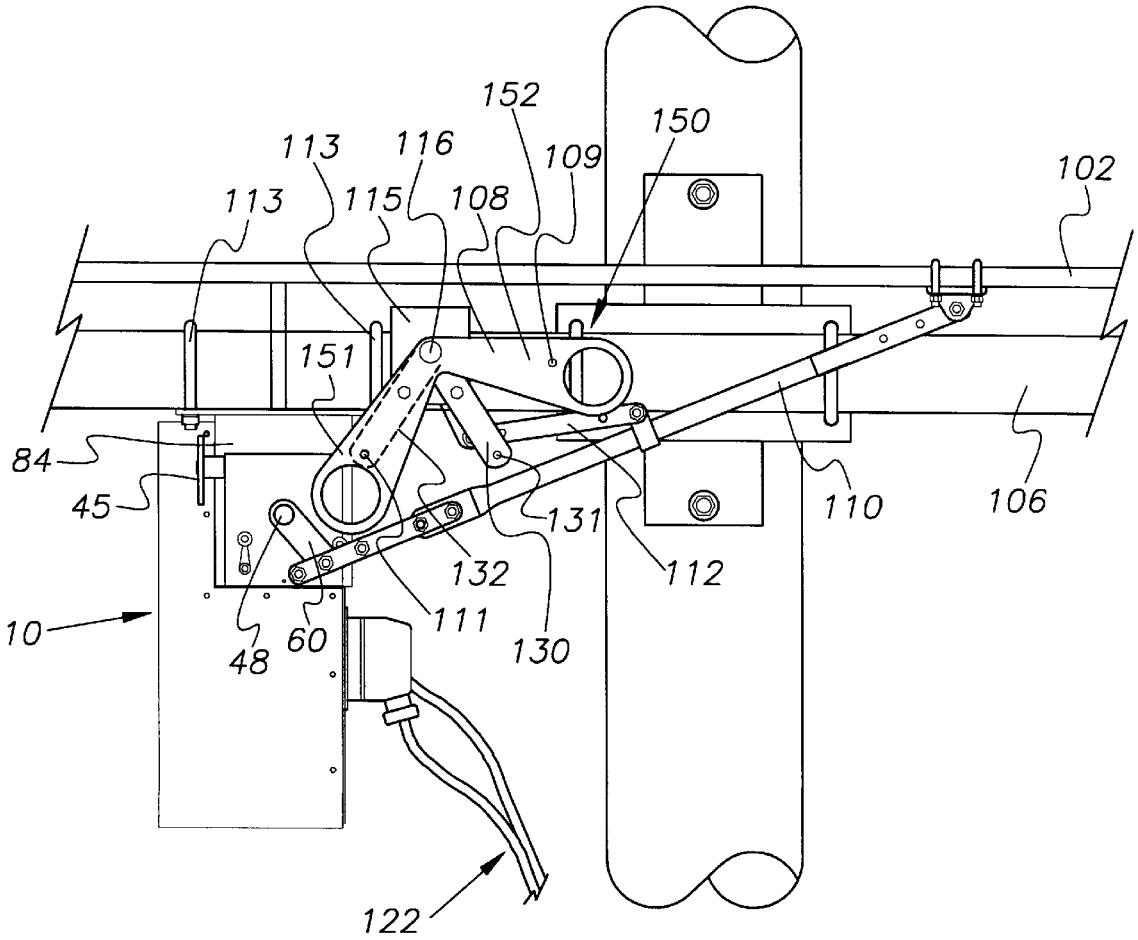
Figure 2:
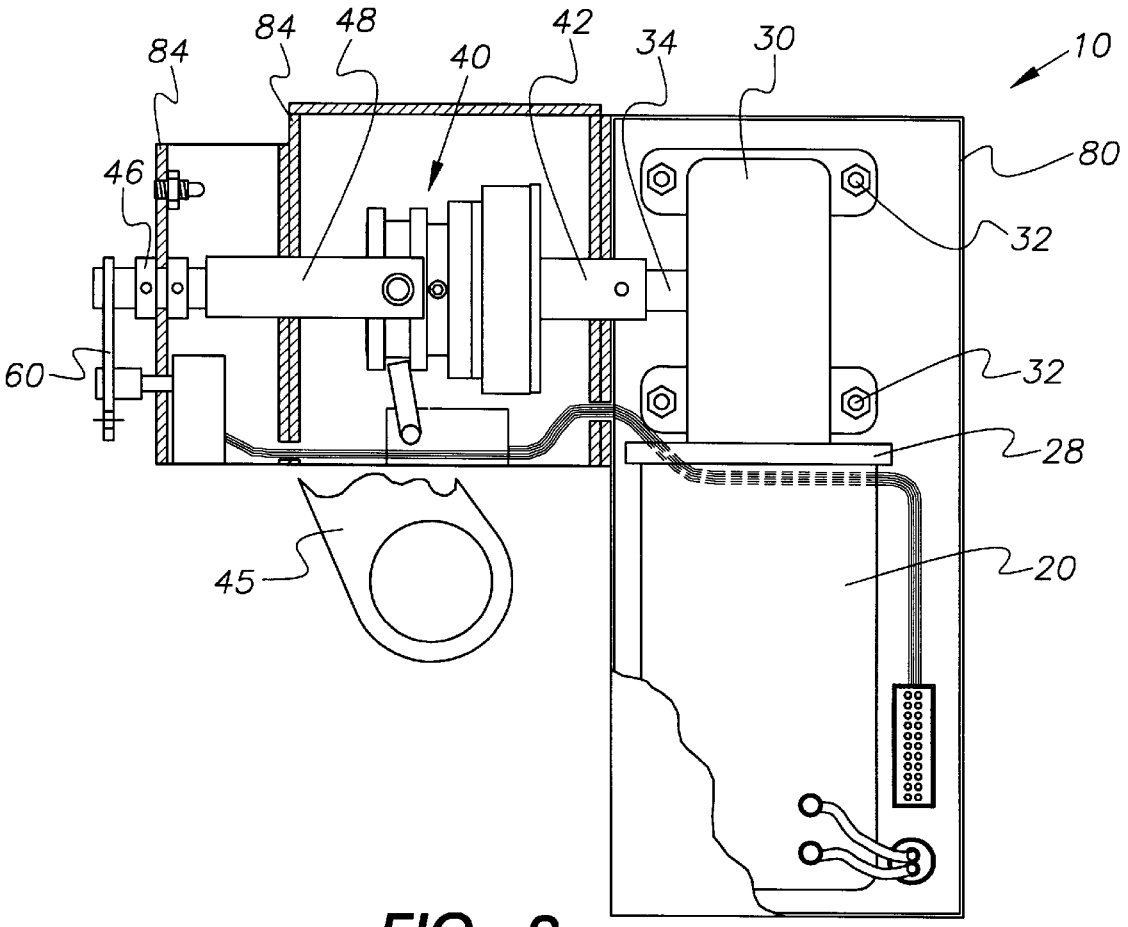
FIG. 2 is a plan view of a preferred embodiment constructed in accordance with the principles and concepts of the present invention.
Figure 3:
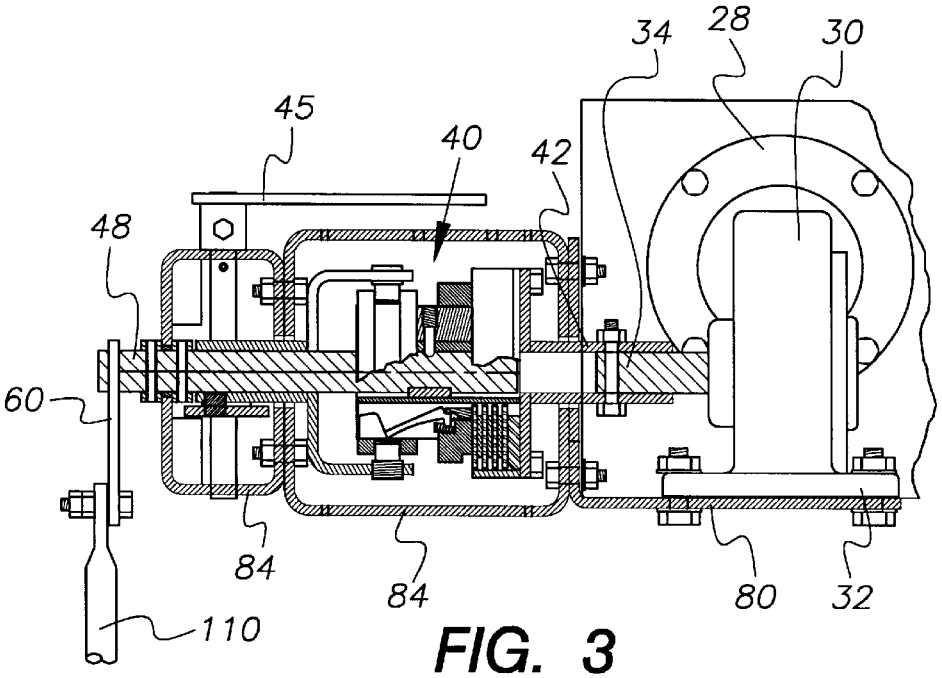
FIG. 3 is an elevation view of a preferred embodiment constructed in accordance with the principles of the present invention.

More specifically, in the first preferred embodiment the present invention is a switch operator 10, as shown in FIGS. 1 through 3. As shown especially in FIG. 2, switch operator 10 comprises a DC motor 20, a gear reduction unit 30, a multiple disc friction clutch 40, and an output coupling 60. Motor 20 is attached at mount plate 28 to a torque increasing, speed reducing gear unit 30 by any suitable means. Gear reduction unit 30 is fastened at mount assembly 32 to motor housing 80. Housing 80 is preferably a weather tight enclosure designed to protect motor 20 and gear reduction unit 30 from weather elements. Gear reduction unit 30 further has output shaft 34 extending therefrom.

Friction clutch 40 has clutch housing 84 that is attached to motor housing 80. Friction clutch 40 has input shaft 42 that journals into clutch housing 84 and extends into motor housing 80 to couple with output shaft 34 of gear reduction unit 30. Friction clutch 40 further has output shaft 48 that journals with bearing 46 in and through housing 84. Output shaft 48 of friction clutch 40 also couples to output lever 60 by any suitable means, as shown in FIGS. 2 and 3. As shown in FIG. 1B, output lever 60 is attached to connecting rod 110 such that rotation of output shaft 48 linearly displaces connecting rod 110 through output lever 60. Friction clutch 40 also has coupling/decoupling arm 45 which effects engagement and disengagement of clutch 40.

In use, switch operator 10 mounts directly to crossarm 106 with brackets 113 attached to clutch housing 84 (see FIG. 1 B). Connecting arm 110 is attached as shown in FIGS. 1 A and 1 B to a phase switch connector rod 102 of the gang-operated switch 100 which allows for simultaneous displacement of the phase switch contacts 114.

Switch operator 10 is controlled by a suitable electronic controller equipment, which in this embodiment is shown as controller 120 connected by electrical lines 122. Electrical lines 122 connect to motor 20 and to limit or position-sensing switches placed in appropriate locations on the switch or the switch operator. When controller 120 energizes DC motor 20, gear reduction unit 30 translates the torsional output of motor 20 to output shaft 34. When friction clutch 40 is engaged, the torque from output shaft 34 translates to output shaft 48 of friction clutch 40. As described above, rotation of output shaft 48 causes linear displacement of connecting rod 110 through output lever 60. The displacement of connecting rod 110 causes the phase switch contacts 114 to move from a closed state to an open state, or vice versa, depending on the direction the connecting rod 110 is moved.

In this embodiment, clutch coupling and decoupling is effected manually by rotating arm 45 of friction clutch 40. Clutch arm 45 is adapted such that the user may employ a "hot stick" or insulated rod commonly used in the field to reach the crossarm mounted switch operator and disengage clutch 40. Decoupling of the friction clutch essentially effects decoupling of the output lever 60 from motor 20. In this state, the user is then free to manually operate the switch. FIGS. 1 A and 1 B disclose a two-armed rotating lever assembly 150 to effect manual closing and opening of the phase switch contacts. (See below.) Furthermore, when clutch 40 is decoupled, the user is free to operate or test DC motor 20 without displacing the phase switch contacts 114. Re-coupling friction clutch 40 to resume automatic operation of the gang-operated switch 100 simply requires the user to rotate clutch arm 45 back to the position that couples the clutch halves of clutch 40. Unlike many prior art devices, the user encounters no alignment and pre-or post-loading problems when either coupling or decoupling the clutch.

The first preferred embodiment also includes manual operation assembly 150 to effect manual operation of the switch. Manual operation assembly 150 comprises mounting bracket 115, lever arm assembly 108, and manual coupling assembly 112. Manual operation assembly 150 is coupled by bracket 115 to crossarm 106. Manual lever arm 108 assembly comprises a first arm 151, a second arm 152, and attachment shaft 116. Attachment shaft 116 journals in and through mounting bracket 115 as shown in FIG. 1B. Attachment shaft 116 also operably attaches to connecting arm 110 by manual coupling assembly 112. To manually operate the switch, the user disengages clutch 40 with disengagement arm 45. Next, the user displaces either the first arm 151 or the second arm 152 as desired to either open or close the switch contacts. Movement of manual lever arm assembly 108 displaces connecting arm 110 through attachment shaft 116 and coupling assembly 112, thereby opening or closing the switch contacts of a gang operated switch.

Additionally, means are provided to lock the switch contacts in place. Such locking means in this embodiment comprises holes 109 and 111 in lever arm assembly 108, and first and second locking struts 130 and 132 extending from mounting bracket 115. As shown in FIG. 1B, rotating arm 152 has hole 109 therethrough which corresponds to hole 131 in locking strut 130. When the switch is in the closed position, hole 109 in rotating arm assembly 108 lies directly over hole 131 in locking strut 130 (not shown). The user may then lock the switch in the closed position by placing a pin or lock through holes 109 and 130. Additionally, rotating arm 151 includes hole 111 which corresponds to a hole in a second locking strut 132. When the switch is in the open position, hole 111 or rotating arm 151 lies directly over the hole in the second locking strut. (See FIG. 1B.) The user is then able to lock the switch in the open position, as discussed above.

SUMMARY

With respect to the above description then, it is to be realized that the optimum dimensional relationships for the parts of the invention, to include variations in size, materials, shape, form, function and manner of operation, assembly and use are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents that may be resorted to fall within the scope of the invention.

What is claimed as being new and desired to be protected by letters of patent of the united states is as follows:

1. A switch operator comprising:

a rotational motor, wherein said rotational motor has an output shaft, an infinite engagement friction clutch coupling, wherein said clutch coupling is coupled to said output shaft of said rotational motor, wherein said clutch coupling is selectively engageable and disengageable, wherein said clutch coupling further has an output shaft, and an output coupling, wherein said output coupling is attached to said output shaft of said clutch coupling, wherein said output coupling is adapted to be operatively coupled to a switch.

2. A switch operator of claim 1 wherein said rotational motor comprises a motor selected from one of the group consisting of: (1) a DC motor, and (2) an AC motor.

3. A switch operator of claim 1 wherein said rotational motor comprises a motor operably attached to a torque-modifying unit, wherein said motor is selected from one of the group consisting of: (1) a DC motor, and (2) an AC motor.

4. A switch operator of claim 1 wherein said infinite engagement friction clutch coupling is selected from the group consisting of: (1) friction clutches, (2) multiple disk friction clutches, (3) cone clutches, (4) internally expanding shoe type clutches, (5) bi-directional grip roller clutches, (6) centrifugal clutches, (7) cam clutches, and (8) two-way slip clutches.

5. A switch operator of claim 1 wherein said infinite engagement friction clutch coupling is coupled and decoupled manually.

6. A switch operator of claim 1 wherein said infinite engagement friction clutch coupling is coupled and decoupled mechanically.

7. A switch operator of claim 1 wherein said infinite engagement friction clutch coupling is coupled and decoupled electromechanically.

8. A switch operator of claim 1 wherein said infinite engagement friction clutch coupling is coupled and decoupled electronically.

9. A switch operator of claim 1 wherein said infinite engagement friction clutch coupling is coupled and decoupled magnetically.

10. A switch operator of claim 1 further comprising a housing that supports and protects the components of said switch operator, wherein said housing is attached to said rotational motor of said switch operator.

11. A switch operator of claim 10 wherein said housing includes means to mount said housing to a switch.

12. A switch operator for operating on a switch having a crossarm, according to claim 11 wherein said housing includes mounting means to attach said switch operator to said crossarm of said switch.

13. A switch operator according to claim 11 wherein said housing includes means to attach said switch operator to a switch pole of an overhead, gang-operated switch.

14. A switch operator of claim 1 wherein said output coupling is adapted to be operatively coupled to a switch.

15. A switch operator of claim 14 wherein said output coupling is a lever, and wherein said switch operator further comprises a connecting arm, wherein said connecting arm is coupled to said lever at a first end, wherein said connecting arm is coupled to an element of an electrical switch at a second end such that movement of said lever effects displacement of said switch through said connecting arm.

16. A switch operator of claim 15 further including a manual operation means to manually operate the switch wherein said manual operation means is attached to said connecting arm.

17. A switch operator according to claim 15 further comprising a manual operation means, wherein said manual operation means comprises a rotating lever arm assembly and a coupling arm assembly, wherein said rotating lever arm assembly comprises a mounting bracket, a first arm, a second arm, and an attachment shaft, wherein said rotating lever arm assembly is secured to an element of an electric switch at said mounting bracket, wherein said attachment shaft is journalled in and through said mounting bracket, wherein first and second arms of said rotating lever arm assembly are attached to said attachment shaft and adapted such that the user may engage them to manually rotate said attachment shaft of said rotating lever arm assembly, wherein said coupling arm assembly is coupled at a first end to said attachment shaft, wherein said coupling arm assembly couples at a second end to said connecting arm such that displacement of said rotating lever arm effects movement of said connecting arm through said attachment shaft and said coupling arm assembly, thereby manually displacing the electric switch.

18. A switch operator of claim 17 wherein said manual operation means further includes locking means engaging said rotating lever arms to lock said manual operation means.

19. A switch operator of claim 18 wherein said first arm includes a first hole therethrough and said second arm of said rotating lever arm assembly includes a second hole therethrough, and wherein said locking means comprises:

first and second locking struts, said first and second locking struts extending from said mounting bracket of said rotating lever arm assembly, said first locking strut having a hole therethrough corresponding to the hole in said first arm of said rotating lever arm assembly such that a pin or lock is insertable through both said hole in said first locking strut and said hole in said first arm of said rotating lever assembly to lock said switch when said switch is in an open position, said second locking strut having a hole therethrough corresponding to the hole in said second arm of said rotating lever arm assembly such that a pin or lock is insertable through both said hole in said second locking strut and said hole in said second arm of said rotating lever assembly to lock said switch when said switch is in a closed position.

20. A switch operator comprising:

a DC motor, wherein said DC motor has an output shaft, a torque-speed modifying unit, wherein said torque-speed modifying unit has an input shaft attached to said output shaft of said DC motor, wherein said torque-speed modifying unit has an output shaft, an infinite engagement disk friction clutch coupling, wherein said clutch coupling is operatively coupled to said output shaft of said torque-speed modifying unit, wherein said clutch coupling is selectively engageable and disengageable, wherein said clutch coupling further has an output shaft, and an output coupling wherein said output coupling is attached to said output shaft of said clutch coupling.

21. A switch operator comprising:

a rotational motor, wherein said rotational motor has an output shaft, an infinite engagement multiple disk friction clutch coupling, wherein said clutch has an input shaft, wherein said input shaft of said clutch coupling couples to said output shaft of said rotational motor means, wherein said clutch coupling is selectively engageable and disengageable, wherein said clutch coupling further has an output shaft, and an output coupling, wherein said output coupling is attached to said output shaft of said clutch coupling, a connecting arm having first and second ends, wherein said connecting arm is attached to said output coupling at said first end, wherein said connecting arm is adapted to be operatively coupled to a switch at said second end such that movement of said connecting arm operatively displaces the switch, a manual operation assembly operably adapted to be connected to the switch, said manual operation assembly comprising:

a rotating lever arm assembly and a coupling arm assembly, wherein said rotating lever arm assembly comprises a mounting bracket, a first arm, a second arm, and an attachment shaft, wherein said mounting bracket is adapted to secure said rotating lever arm assembly to a switch, wherein said attachment shaft is journalled in and through said mounting bracket, wherein first and second arms of said rotating lever arm assembly are attached to said attachment shaft and adapted such that the user may engage them to manually rotate said attachment shaft, wherein said coupling arm is coupled at a first end to said attachment shaft, wherein said coupling arm couples at a second end to the connecting arm such that displacement of said rotating lever arm assembly effects movement of said connecting arm through said attachment shaft and said coupling arm, thereby manually displacing an electric switch.

22. The switch operator of claim 10 wherein said housing further includes a bracket attached on the outer surface thereof for mounting said switch operator to a switch.

* * * * *